United States Patent [19]

Leander

[11] Patent Number: 5,010,713

[45] Date of Patent: Apr. 30, 1991

[54] APPARATUS FOR PACKAGING FISHES IN CANS

[75] Inventor: Leif Leander, Askim, Sweden

[73] Assignee: VMK Fish Machinery AB, Goteborg, Sweden

[21] Appl. No.: 381,184

[22] Filed: Jul. 18, 1989

[30] Foreign Application Priority Data

Jul. 20, 1988 [SE] Sweden ..... 8802684-4

[51] Int. Cl.[5] ..... B65B 5/08; B65B 35/56

[52] U.S. Cl. ..... 53/142; 53/247; 53/252; 53/542; 53/544

[58] Field of Search ..... 53/247, 252, 438, 439, 53/473, 529, 534, 251, 255, 258, 542, 544, 142

[56] References Cited

U.S. PATENT DOCUMENTS

| | | | |
|---|---|---|---|
| 3,408,926 | 11/1968 | Rogerson | 53/529 X |
| 3,479,795 | 11/1969 | Martin | 53/540 |
| 3,641,735 | 2/1972 | Daily et al. | 53/540 X |
| 3,854,270 | 12/1974 | Cloud et al. | 53/252 X |
| 4,107,904 | 8/1978 | Helgesen . | |
| 4,476,665 | 10/1984 | Oberdorf | 53/252 X |
| 4,519,179 | 5/1985 | Meier | 53/525 X |
| 4,617,783 | 10/1986 | Manservisi | 53/529 |
| 4,627,215 | 12/1986 | Walz | 53/534 X |
| 4,733,518 | 3/1988 | Griesdorn | 53/534 X |

FOREIGN PATENT DOCUMENTS 431931 3/1984 Sweden .

*Primary Examiner*—Robert L. Spruill
*Assistant Examiner*—Linda B. Johnson
*Attorney, Agent, or Firm*—Wegner, Cantor, Mueller & Player

[57] ABSTRACT

A method and an apparatus for packaging items, for example herring, sardines or similar fishes in cans, is provided. The fish are conveyed at continuous speed lying on a conveyor with a predetermined longitudinal and transversal orientation. The foremost fish on the conveyor is moved while maintaining its orientation to a first compartment in a line of compartments adjacent the path of the conveyor. The next following fish on the conveyor is moved correspondingly to the next following compartment in the line, until the number of fishes in the compartments equals the number of fishes to be canned in one can. The line of compartments is then shifted away from the conveyor to a can, while the fishes are turned around their longitudinal axis within the compartments to a predefined position. Finally, the fishes are pressed out of the compartments and into the can.

8 Claims, 5 Drawing Sheets

APPARATUS FOR PACKAGING FISHES IN CANS

FIELD OF THE INVENTION

The present invention relates to a method for packaging fishes like for example herring, sardines or similar fishes in cans, wherein the fish is conveyed at continuous speed lying on a conveyer with a predetermined longitudinal and transversal orientation. The invention also relates to an apparatus for performing the method.

STATE OF THE ART

Normally, when packaging fishes in cans as above, it is necessary due to lack of space, that the fishes are laid alternately in the can, so that about half the number of the comparatively wider head ends are placed at each respective end of the can. Also, it is not unusual when canning small fish, like for instance herring, baltic herring or sardines, that the fish according to practice is placed on its back in the can with the belly upwards.

This demand for exact orientation of the fishes both longitudinally and transversely, has so far meant that the packaging in cans had to be done manually. The manual handling of each fish is labour demanding and repetitious.

Naturally, efforts have been made to automatize the canning of individually treated fishes, but on account of difficulties in maintaining full reliability at normal production speed, i.e. so that each can contains the accurate number of fishes properly oriented both longitudinally and around its longitudinal axis, such machines and methods have not been successful, and therefore it has been necessary to rely upon manual labour.

Also one machine is known, in which a group of fishes is first formed, the number in the group corresponding to the number of fishes which is going to be packaged into one can. Then this group goes through a mutual treatment in the form of beheading, cutting of the tail and gutting. After this treatment, the group is simultaneously placed in the can. Nevertheless, this treatment in a group has shown to give inadequate results, especially for small relatively soft types of fish, because the size of the fish usually vary. Therefore, the cutting of the fish at the head and tail ends will be a compromise, which may result in that some fishes are deficiently cut, and on the other hand valuable fish meat may be lost at other fishes.

OBJECTS OF THE INVENTION

The object of the present invention is therefore to provide a method and an apparatus which enables automatized packaging of individually treated small fishes according to the above, with full reliability and at a high production speed.

SUMMARY OF THE INVENTION

According to the invention, this object is achieved by moving the foremost fish on the conveyor while maintaining its orientation to a first compartment in a line of compartments adjacent the path of the conveyer, moving the next following fish on the conveyer correspondingly to the next following compartment in the line, until the number of fishes in the compartments equals the number of fishes to be canned in one container, shifting the line of compartments away from the conveyer to a can while the fishes are turned around their longitudinal axis within the compartments to a predefined position, and pushing the fishes out of the compartments and into the can.

According to one preferable embodiment of the invention, the distances between those side walls which define the compartments are reduced, while the compartments are shifted to the can.

Preferably each compartment bottom surface is folded down, during the shifting of compartments to the can.

The apparatus according to the invention is characterized in at least two matrix means, each of which comprises a group of compartments being provided with side walls and movable, so that one compartment group is adjacent the conveyer when another group is adjacent the can.

In one preferable embodiment of the invention, the side walls of the compartments can be moved towards each other from an outer position, against the action of spring means.

Preferably, each of the compartments is provided with a bottom floor which can be folded downward from a substantially horizontal plane.

In a further preferable embodiment of the invention, the conveyer is provided with a drive shaft which is driven step-by-step and connected via a transmission to a vertical shaft having four matrix means mounted at equal angular distance around a theoretical circumference, so that the matrix means can be moved step-by-step a quarter of a turn as soon as the number of fishes being delivered by the conveyer corresponds to the number of fishes which may be packed into one can.

Preferably, the side walls in those compartments which form the matrix means are mounted on two parallel guide shafts and pressed apart by means of spring means which are mounted upon the shafts between the respective adjacent side walls.

Further, a first guide cam may be rigidly mounted at the journal point of the vertical shaft and arranged for cooperation with cam following means, for sideways displacement of the compartment side walls along the guide shafts.

Also, a second guide cam is arranged governing of the compartment bottom surfaces.

BRIEF DESCRIPTION OF THE DRAWINGS

One embodiment of the invention will now be described in further detail, with reference to the accompanying drawings, in which.

DESCRIPTION OF A PREFERRED EMBODIMENT

The machine shown in the figures conveys fishes 10 lying one by one, each in its separate tray 11 on a conveyer 12. The heads and tails of the fishes have been cut off at an earlier stage and also, every second fish has been turned on the conveyer, so that every second fish lies with its head end towards one side and every second fish lies with its head end towards the other side of the conveyer, i.e. across their direction of travel. Also, the fishes are oriented in the trays with the back side upwards.

Figure 1:
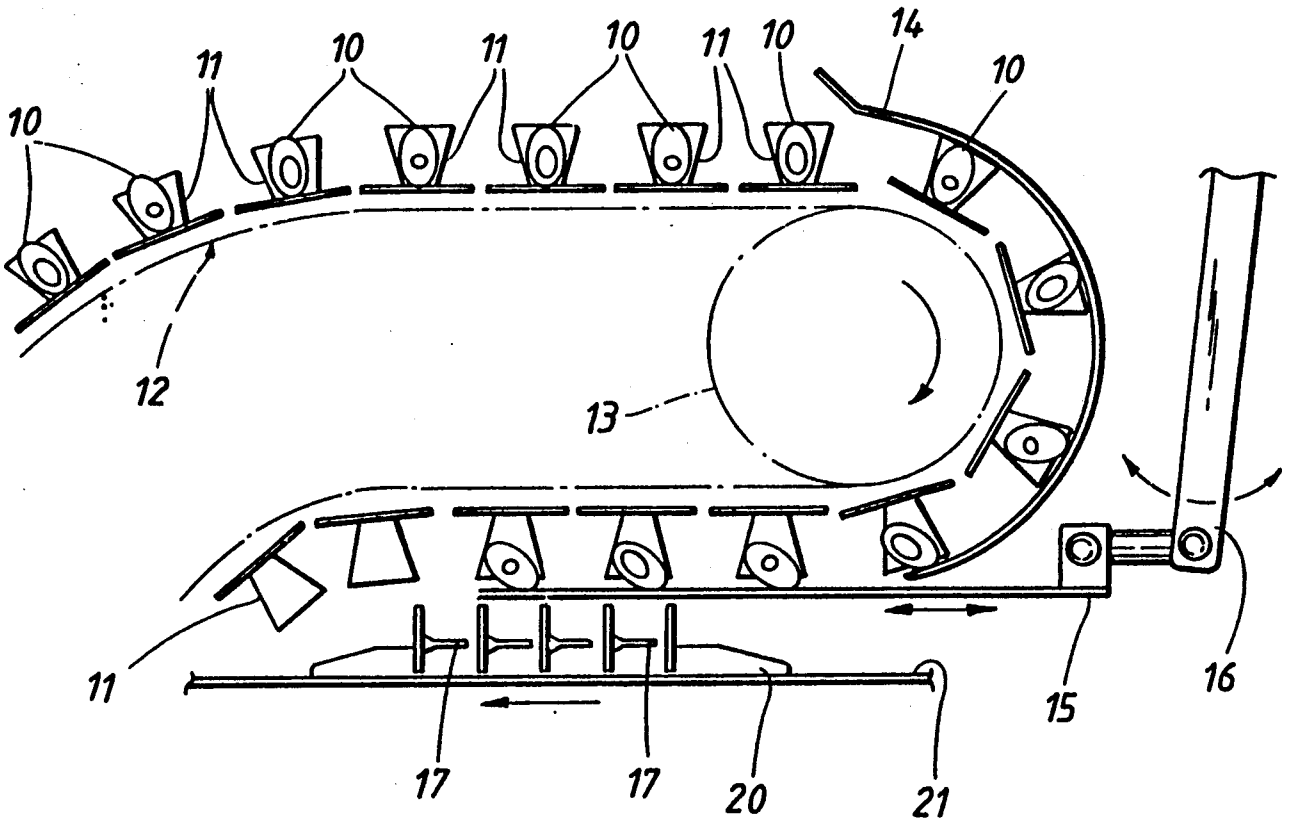
FIG. 1 is a schematic side view depicting a first stage of the method at which fishes are moved over from a conveyer to a manipulator means.

The endless conveyer 12 runs from the left side of FIG. 1, around a pulley wheel 13 and back in the direction of the left side of FIG. 1 with the trays 11 turned downward. In the area of the pulley wheel 13, the trays now pass a turnover plate 14, which retains the fishes 10 in their respective trays 11 during said turning downward. From FIG. 1 it is also clear that the fishes, while their weight successively is moved over to the stationary turnover plate 14, are turned somewhat around their longitudinal axis, by the action of friction, in the counter clockwise direction in FIG. 1.

The turnover plate 14 connects at the underside of the pulley wheel 13 to a receptor plate 15 which is moved in a reciprocating motion in parallel to the adjacent part of the conveyer, through the action of an reciprocating pivot arm 16 which is provided with a linkage driven in synchronism with the conveyer.

Figure 2:
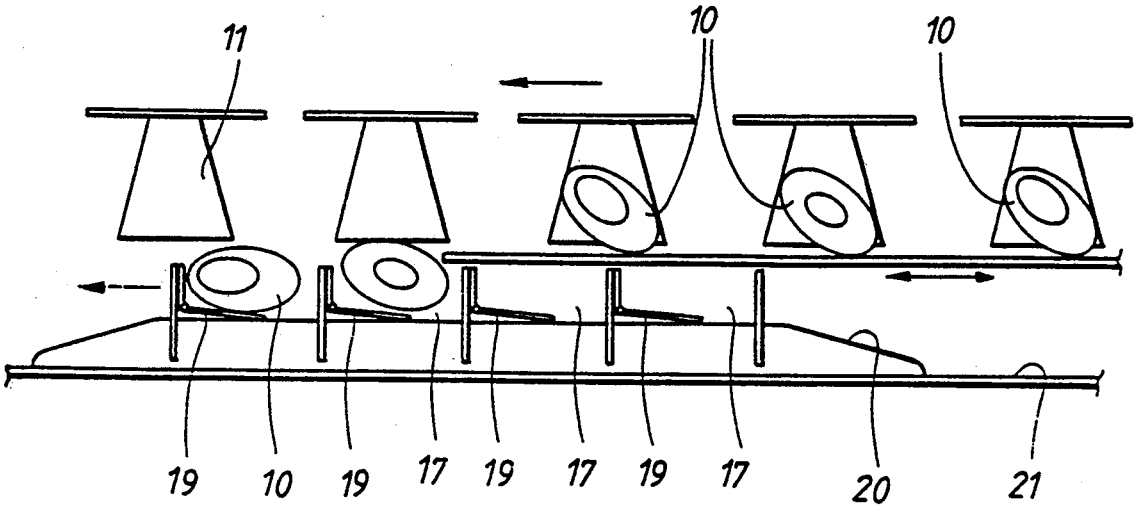
FIG. 2 is a partial enlargement of FIG. 1.
Figure 4:
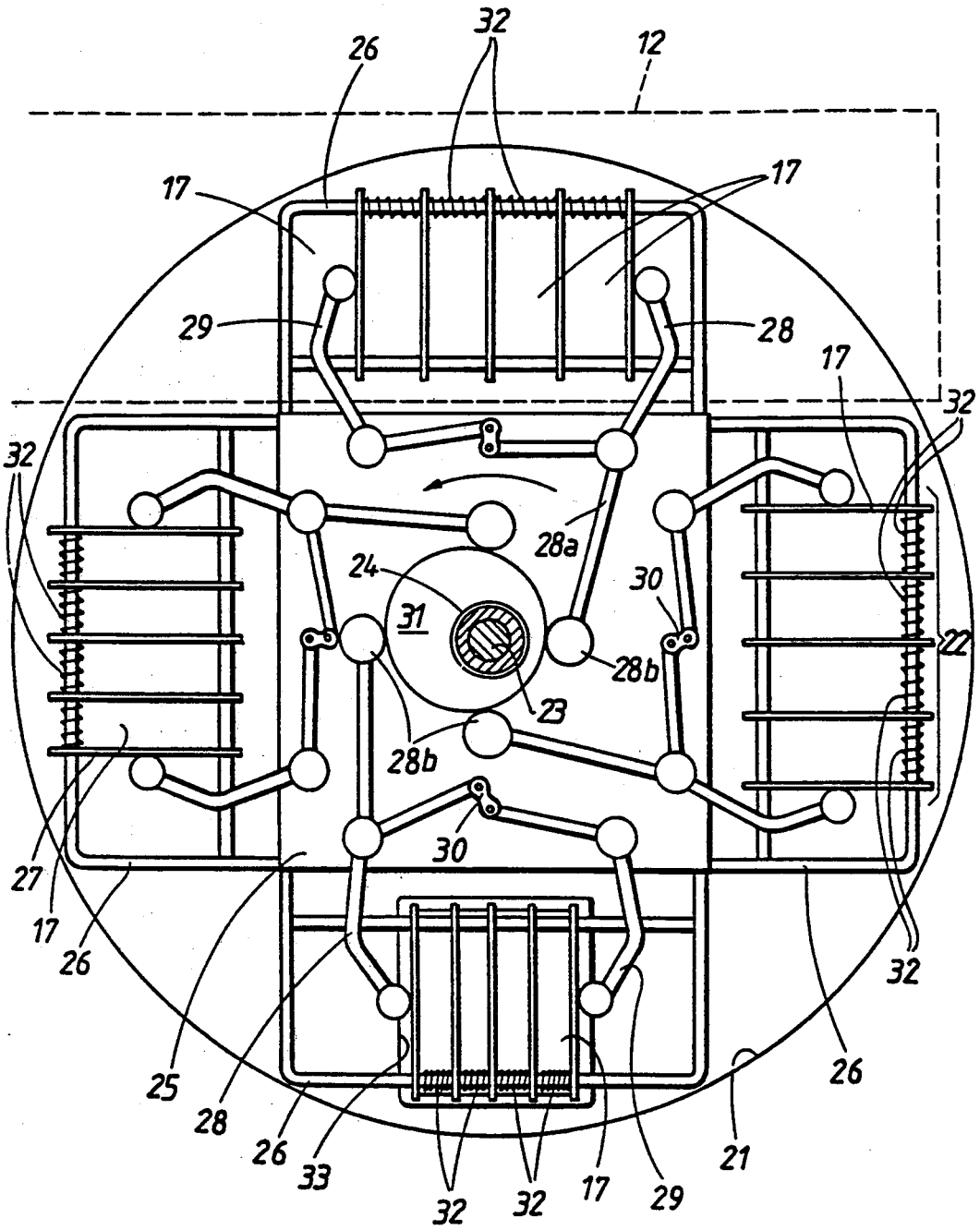
FIG. 4 shows the manipulator in a view from above.

The receptor plate 15 in FIG. 1 is shown in its left end position, in which it covers three of the four compartments 17 belonging to a manipulator apparatus shown in FIG. 4, and at which position the foremost fish 10 on the conveyer soon will fall a short distance down into the remaining open compartment 17. Then the plate 15 moves, as shown in FIG. 2 show, back towards the right side of the figure, wherein a second compartment 17 lain bare and the next following fish in the conveyer can fall down into said compartment. This cycle will be repeated until all four compartments 17 have received a fish lying with its belly side turned towards the left side of the figure, wherein the plate 15 starts to move in the opposite direction, i.e. the left side of the figure and the plate moves with approximately the same speed as the conveyer to the end position shown in FIG. 1.

Simultaneously, the manipulator apparatus is rotated until a new group of empty compartments 17 are present below the plate 15.

From FIGS. 1 and 2 it is evident that each compartment 17 is provided with bottom surface 19 which is pivotally connected to one side of the compartment. The pivot angle of each bottom surface 19 is governed by a guide cam 20 which is rigidly connected to a table surface 21, below the receptor plate 15. When the manipulator apparatus moves the compartment group 17 from the position shown in FIGS. 1 and 2, i.e. away from the guide cam 20, as shown in FIG. 3, the plates 19 are pivoted downward into the compartments 17 resulting in that the fishes 10 lie, as described above, alternatingly with the head end towards each side and with the belly towards the left in the compartment, and are turned clockwise in FIG. 3 around their longitudinal axis.

Figure 6:
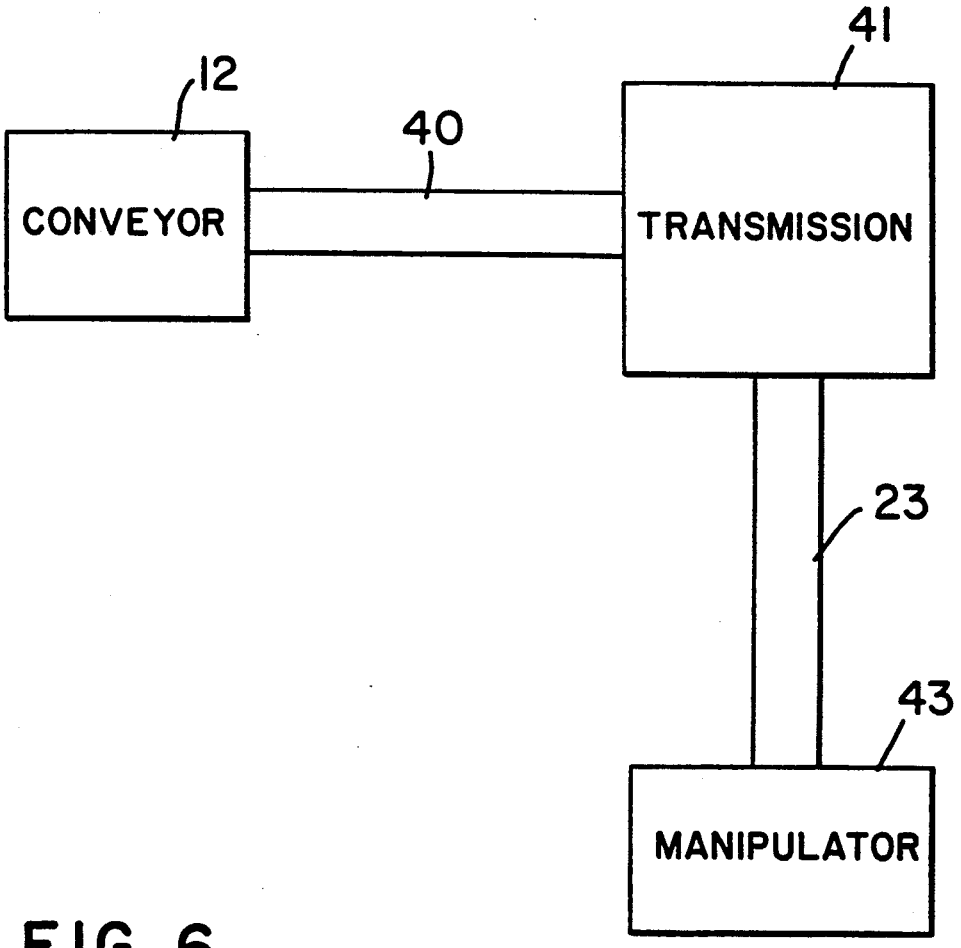
FIG. 6 schematically illustrates a transmission connecting a drive shaft of the conveyor and a vertical shaft of the manipulator.

FIG. 4 shows the manipulator apparatus in view from above, wherein it is clear that it comprises four groups 22 of compartments 17 arranged at mutual angular distances of a quarter of a turn around a vertical shaft 23, which is journalled in a coaxial sleeve 24, and runs upwards to transmission 41, which is connected to the drive shaft 40 of the conveyor 12, as schematically shown in FIG. 6. The vertical shaft 23 of the manipulator 43 is rotated in steps of 90° in synchronization with the conveyer 12, and connected to a square plate 25 carrying the four groups 22 of compartments via horizontal guide frames 26.

The compartments 17 are formed by five side walls 27, of which all walls but the wall in the middle can be displaced in relation to its respective guide frame 26. Said displacement takes place by means of a claw formed mechanism which is arranged for each of the groups and comprises two arms 28, 29, which are pivotally journalled at the plate 25 and interconnected via a pair of angled limbs and links 30, and wherein one of said arms 28 is provided with a lever **28*a*. The lever 28*a* has a cam follower 28*b* which abuts an eccentric cam 31 rigidly connected to the sleeve 24. When the shaft 23 is turned in steps in the counter clockwise direction in FIG. 4, the upper group 22 of compartments is moved from the position shown in FIGS. 1 and 2 below the conveyer 12, and the claw formed mechanism will press the outer side walls 17 towards the central rigid side wall, against the action of spring means 32 acting to press the compartment 17 side walls 27** apart.

Figure 3:
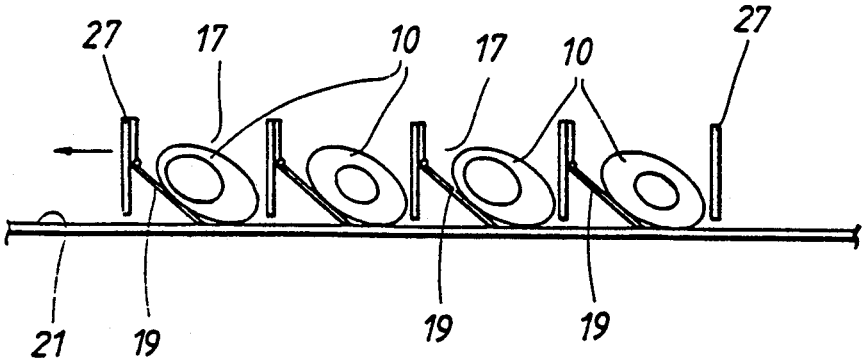
FIG. 3 is a schematic side view of the manipulator during a following stage of the method.
Figure 5:
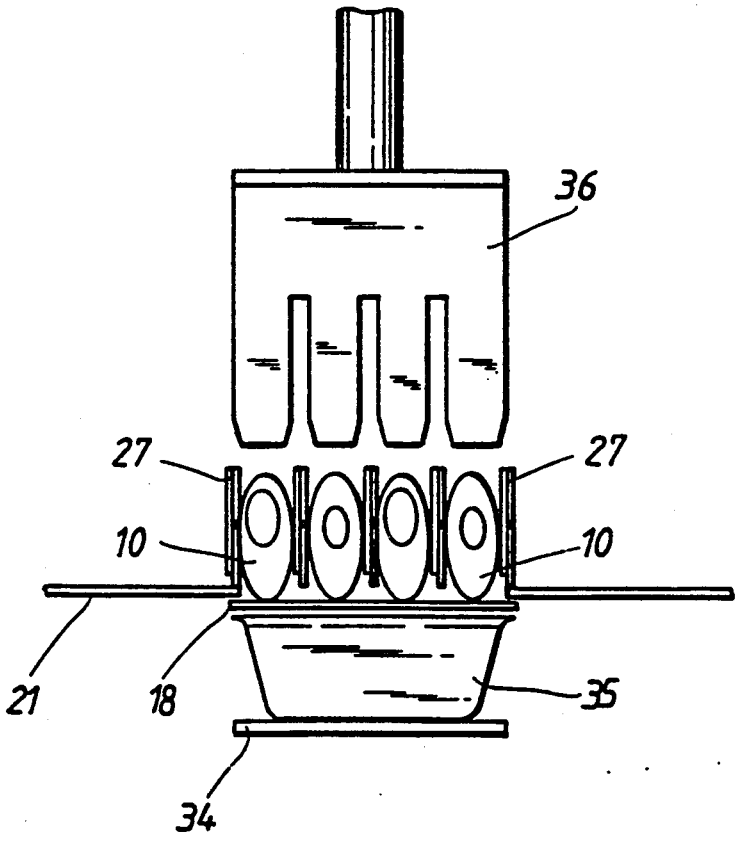
FIG. 5 shows the manipulator in a side view, during a final stage of the method, in which the fishes are about to be pressed into a can.

The left group 22 shown in FIG. 4 is in a position approximately corresponding to the position shown in FIG. 3. Now the group 22 has been moved away from the guide cam 20, so that bottom surfaces 19 have been pivoted down and the backs of the fishes 10 partly abuts the table surface 21. Simultaneously, the compartment walls 27 have been pressed together partly by the claw mechanism 28–30 resulting in a rotation of the fishes, so that their belly side is moved upwards in the respective compartment 17, while the width of the compartment is reduced. The bottom group 22 shown in FIG. 4 is presently directly above an opening 33 in the table surface 21. In this position, the claw mechanism 28–30 have pressed the compartment walls 27 together as much as possible. This position is also shown in FIG. 5, from which it is evident that the fishes now have been rotated around their longitudinal axis, so that their belly side is upwards. Below the opening 33 there is a conveyer 34 for transporting cans 35, which is in synchronization with the step-by-step rotation of the manipulator apparatus, so that an open and empty can 35 always is ready when the group of fishes have been rotated to the position shown in FIG. 5. When the group of fishes reaches that position, the opening 33 is covered by a plate 18. In this position, there is a press means 36 arranged above the group of compartments 17, and adapted to simultaneously press the four fishes vertically down into the can 35. The plate 18 is pulled away immediately before activation of the press means 36 ensuring that no part of any fish can move out of its compartment before any of the other fishes.

During the next following rotation step, the eccentric cam 31 allows the compartments to move apart through the action of the springs 32.

By means of the above described method and apparatus, the grouping and canning of the fishes are therefore accomplished by a very exact and careful guiding of each fish, so that four fishes will be lying in each can with the belly side upwards in such a manner that every second fish lies with its head end towards one side and every other fish lies with its head end towards the other side. One prototype of the apparatus according to the invention has been produced and tested for a normal work speed of 50 cans per minute, i.e. 200 fishes per minute. However, it is comparatively simple to modify the apparatus according to the invention, so that for example five or six fishes are placed side-by-side in a can. Then, one can simply exchange the groups 22 of compartments 17 for another kind of grouping. With further simple modifications, the method and apparatus can be modified in such a way, that the fishes lie in two layers in the can.

Therefore, the invention is not limited to the above described embodiment, but several modifications are possible within the scope of the accompanying claims. For example, the insertion of fishes into the compartments can be made in other ways than shown. The number of groups 22 of compartments in the manipulator apparatus can also vary, as well as the number of compartments in these groups. The groups 22 can be moved by other means than rotation around a shaft, e.g. by means of an endless conveyer. Also, the means for variation of the compartment width can be designed in many different ways. Further, the apparatus can be modified in such a way that the pressing of the fishes out of the compartments is done horizontally instead of vertically.

What we claim:

1. An apparatus for packaging fish in cans comprising:

conveyor means for conveying fish at a substantially continuous speed wherein each fish is positioned on the conveyor means with a predetermined longitudinal and transverse orientation;

a vertical shaft cooperating with said conveyor means; and at least two matrix means for delivering said fish from said conveyor means to said cans, each of said matrix means connected to said vertical shaft and comprising a plurality of adjacent compartments wherein any two adjacent compartments are separated by a side wall, and wherein each of said matrix means are spaced at an equal angular distance around said vertical shaft;

said conveyor means cooperating with said vertical shaft such that said conveyor means conveys fish at a substantially continuous speed to one of said matrix means, whereby said vertical shaft rotates said matrix means in increments, said vertical shaft rotating one increment after a predetermined number of fish are delivered by the conveyor means to one of said matrix means.

2. An apparatus according to claim 1, wherein the side walls of the compartments can be moved towards each other from an outer position, against the action of spring means.

3. An apparatus according to claim 1, wherein each of the compartments is provided with a bottom floor which can be folded downward from a substantially horizontal plane.

4. An apparatus according to claim 1, wherein the side walls in those compartments which form the matrix means are mounted on two parallel guide shafts and pressed apart by means of spring means which are mounted upon the shafts between the respective adjacent side walls.

5. An apparatus according to claim 4, wherein a first guide cam is rigidly mounted at a journal point of the vertical shaft and arranged for cooperation with cam following means, for sideways displacement of the compartment side walls along the guide shafts.

6. An apparatus according to claim 5, wherein each of the compartments is provided with a bottom floor which can be folded downward from a substantially horizontal plane, and wherein the apparatus includes a second guide cam for controlling the bottom floors of the compartments.

7. An apparatus according to claim 1, wherein four matrix means are connected to the vertical shaft, the vertical shaft rotating the matrix means in increments of 90°.

8. The apparatus according to claim 1, further comprising means for conveying said cans to said matrix means such that one of said cans is conveyed by said means for conveying said cans in a position to receive said predetermined number of fish from said matrix means after said matrix means has been rotated at least one increment away from said conveyor means.

* * * * *